United States Patent [19]

Hade, Jr. et al.

[11] Patent Number: 4,757,875

[45] Date of Patent: Jul. 19, 1988

[54] VEHICULAR LOW PROFILE SELF PROPELLED AERIAL WORK PLATFORM

[75] Inventors: Donald C. Hade, Jr., Waynesboro; Robert D. Backer, Rouzerville, both of Pa.

[73] Assignee: Kidde, Inc., Saddle Brook, N.J.

[21] Appl. No.: 101,016

[22] Filed: Sep. 25, 1987

[51] Int. Cl.[4] ..... B66F 11/04

[52] U.S. Cl. ..... 182/2; 212/261; 212/266

[58] Field of Search ..... 182/2, 141, 148; 212/266, 267, 268, 261

[56] References Cited

U.S. PATENT DOCUMENTS

| | | | |
|---|---|---|---|
| 2,996,141 | 8/1961 | Eitel | 182/2 |
| 3,103,345 | 9/1963 | Eitel | 182/2 |
| 3,448,827 | 6/1969 | Clark | 182/2 |
| 3,856,108 | 12/1974 | Grove | 182/2 |
| 3,861,498 | 1/1975 | Grove | 182/2 |
| 4,000,787 | 1/1977 | Groenig | 182/2 |
| 4,160,492 | 7/1979 | Johnston | 182/2 |
| 4,226,300 | 10/1980 | Rallis | 182/2 |
| 4,273,214 | 6/1981 | Grove | 182/2 |

*Primary Examiner*—Reinaldo P. Machado
*Attorney, Agent, or Firm*—Brady, O'Boyle & Gates

[57] ABSTRACT

A vehicular low profile self propelled aerial work platform assembly having a turntable positioned in a horizontal plane in close proximity to the axles of the vehicle. A parallelogram linkage is provided between a superstructure support frame carried by the turntable and a riser frame assembly to which one end of a telescopic boom assembly is pivotally connected, the aerial work platform being mounted on the outermost end of the telescopic boom assembly. A counterweight is detachably connected to the support frame and is formed with a trough aligned with a similar trough provided in the support frame, the parallelogram linkage includes a pair of tubular arms which extend through the troughs when the work platform is in the lowermost position. When in the lowermost position, the height of the pivotal connection of the telescopic boom assembly to the riser frame assembly is approximately eight feet allowing the assembly to be employed in warehouses and manufacturing plants having low and narrow doorways and aisles. The support frame and parallelogram linkage are symmetrical with respect to the centerline of the machine to thereby distribute stresses equally through the machine. When in the elevated position, the superstructure support frame, parallelogram linkage, and counterweight are positioned within the wheelbase of the vehicle to thereby provide a zero tailswing.

17 Claims, 4 Drawing Sheets

20
42
44
18
4
45
14
36
9
48
42
10
19
18
50
39
11
6
17
5
5.
5.
1
15
29
2
10
25
22
7
11
27
24
8
16
21
29
3
21
4
4.

FIG. 4
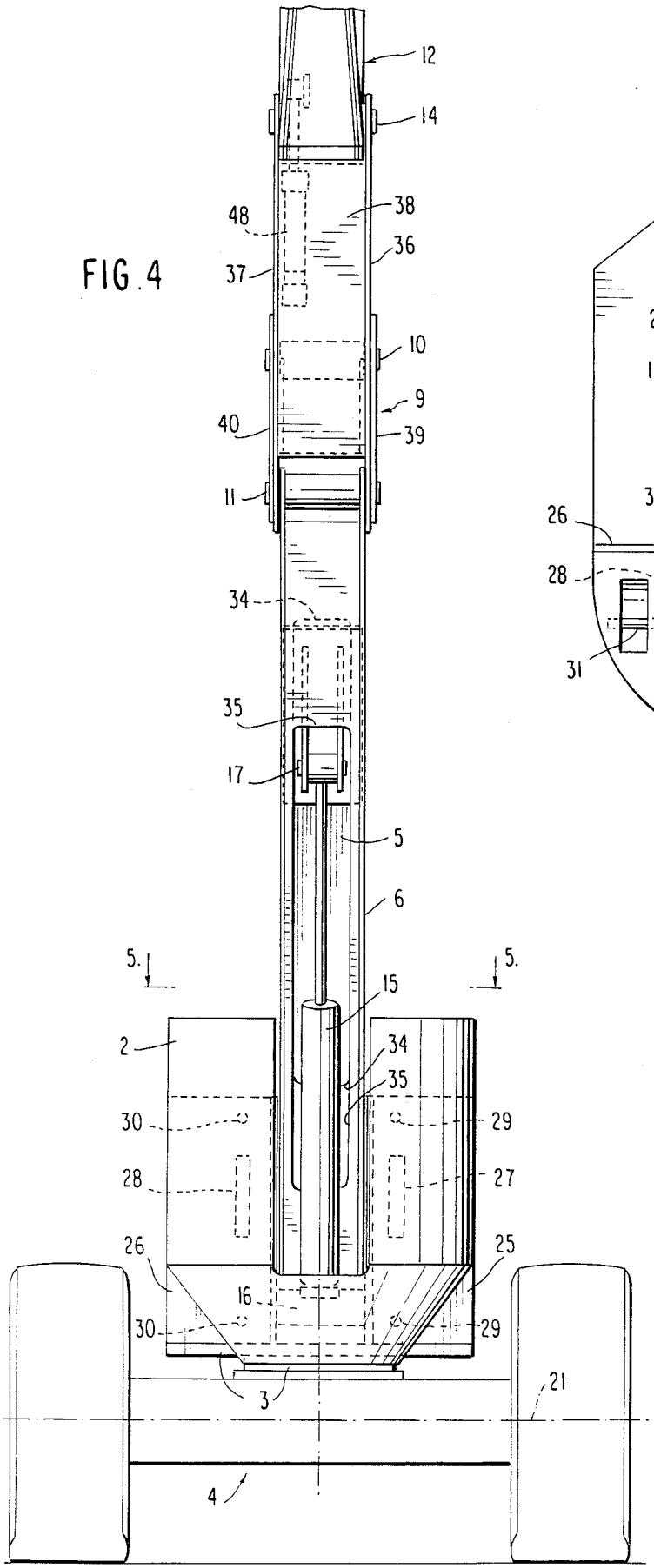
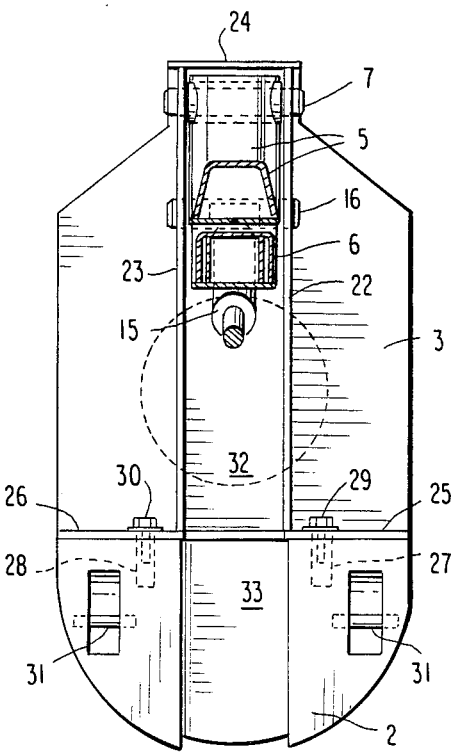
FIG. 5

VEHICULAR LOW PROFILE SELF PROPELLED AERIAL WORK PLATFORM

BACKGROUND OF THE INVENTION

Various vehicular self propelled aerial work platforms have been proposed wherein a pedestal or housing is mounted on a turntable carried by a vehicle. A boom assembly, having a work platform mounted on its outer end, is either pivotally connected directly to the pedestal or through suitable linkage. While these known mobile aerial work platforms have been generally satisfactory for their intended purpose, they have been characterized by their size and reach capabilities thereby precluding their use in relatively small work areas, such as, in warehouses and manufacturing plants having low and narrow doorways and narrow aisles, but requiring high working heights.

After considerable research and experimentation, the vehicular self propelled work platform of the present invention has been devised having a low profile and a narrow width so that it can be maneuvered through low and narrow doorways and aisles in warehouses and manufacturing plants. The vehicular low profile self propelled aerial work platform of the present invention comprises, essentially, a turntable mounted on a vehicle chassis and positioned in a horizontal plane in close proximity to the axles of the vehicle. A parallelogram linkage including a pair of tubular arms is provided between a superstructure support frame carried by the turntable and a riser frame assembly to which one end of a telescopic boom assembly is pivotally connected, the aerial work platform being mounted on the outermost end of the telescopic boom assembly. A counterweight is detachably connected to the support frame and is formed with a trough aligned with a similar trough formed by closely spaced side walls on the superstructure support frame. The tubular arms extend through the troughs when the telescopic boom assembly is lowered to a negative angle for easy access to the work platform. When in this lowered position, for example, the height of the vehicle and associated linkage is approximately eight and a half feet for a machine that provides a work platform height of sixty feet thereby allowing the assembly to pass through nine foot doorways.

The support frame, tubular arms, riser frame assembly and pivotal connection of the telescopic boom to the rise frame assembly are constructed and arranged to be symmetrical with respect to the centerline of the machine whereby load stresses are equally distributed from the telescopic boom to the riser assembly through the tubular arms superstructure side walls and turntable to the chassis. When in the elevated position, the riser frame assembly, tubular arms, superstructure support frame and counterweight are positioned within the wheelbase of the vehicle, to thereby provide a zero tailswing; that is, no component extends beyond the wheels of the vehicle during the sluing of the superstructure and the telescopic boom assembly.

BRIEF DESCRIPTION OF THE DRAWINGS

FIG. 4 is a fragmentary rear elevational view taken substantially along line 4—4 of FIG. 3; and FIG. 5 is a top plan view, partly in section, taken substantially along line 5—5 of FIG. 3.

DESCRIPTION OF THE PREFERRED EMBODIMENT

Figure 1:
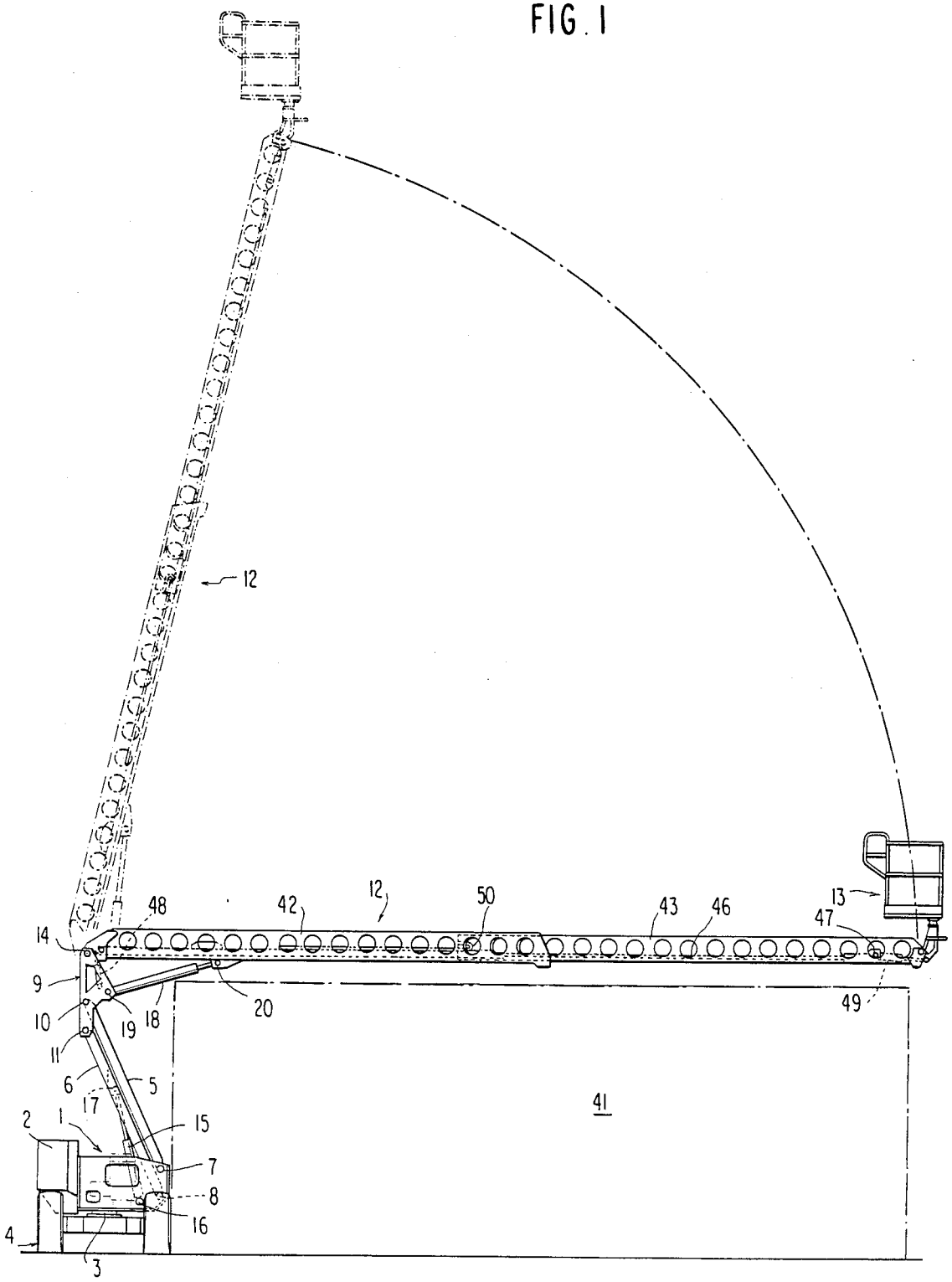
FIG. 1 is an elevational view of the vehicular low profile self propelled aerial work platform of the present invention showing the work platform in different working positions.
Figure 2:
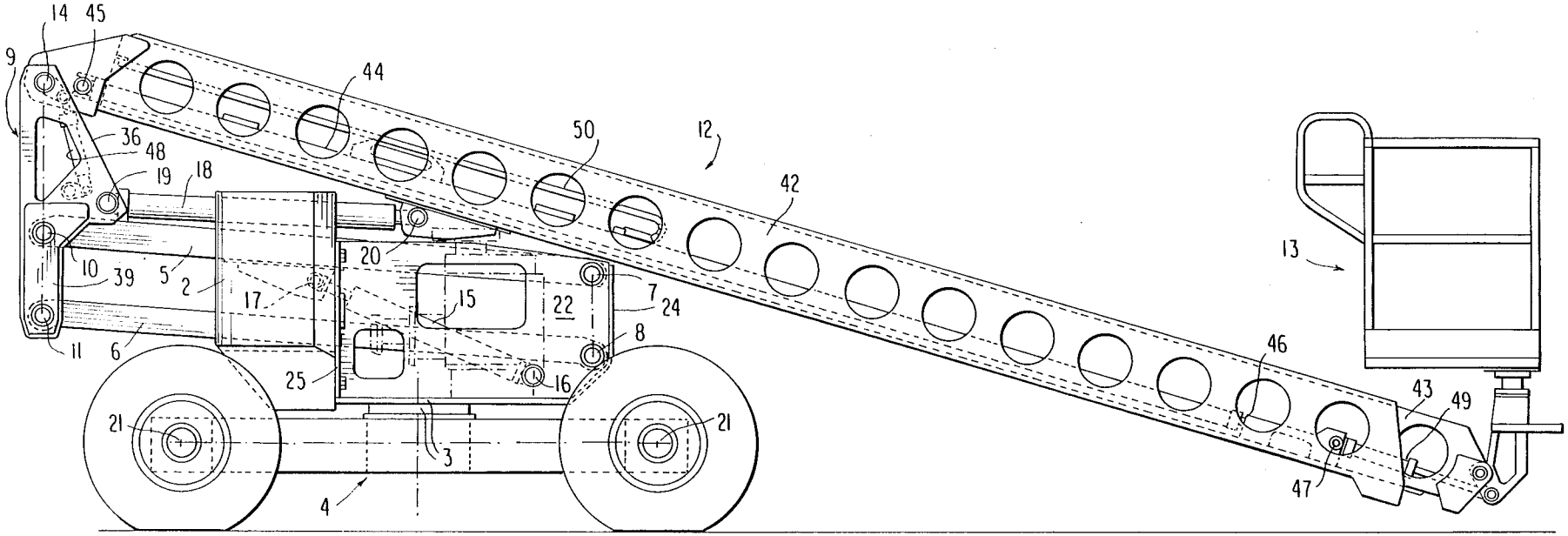
FIG. 2 is a side elevational view of the vehicle of the present invention showing the telescopic boom assembly and associated work platform lowered to a negative angle to provide access to the platform.

Referring to the drawings and more particularly to FIG. 1, the vehicular low profile self propelled aerial work platform of the present invention comprises a superstructure support frame 1, having a counterweight 2, mounted on a turntable 3 carried by a vehicle chassis 4. A pair of substantially parallel tubular arms 5, 6 are each pivotally connected at one end to the support frame as at 7 and 8, and at the opposite end to a riser frame assembly 9, as at 10 and 11. A telescopic boom assembly 12, having a work platform 13 mounted on its outermost end, is pivotally connected to the riser frame assembly as at 14. A lower lift cylinder 15 is connected between the support frame 1 and the tubular arm 5 as at 16 and 17, respectively, whereby the tubular arms 5 and 6 and riser frame 9 may be raised and lowered with respect to the vehicle. A boom lift cylinder 18 is similarly connected between the riser frame assembly as at 19 and the base section of the telescopic boom assembly 12 as at 20, whereby the telescopic boom assembly can be raised and lowered with respect to the riser frame assembly 9, as shown in FIGS. 1, 2 and 3.

Figure 3:
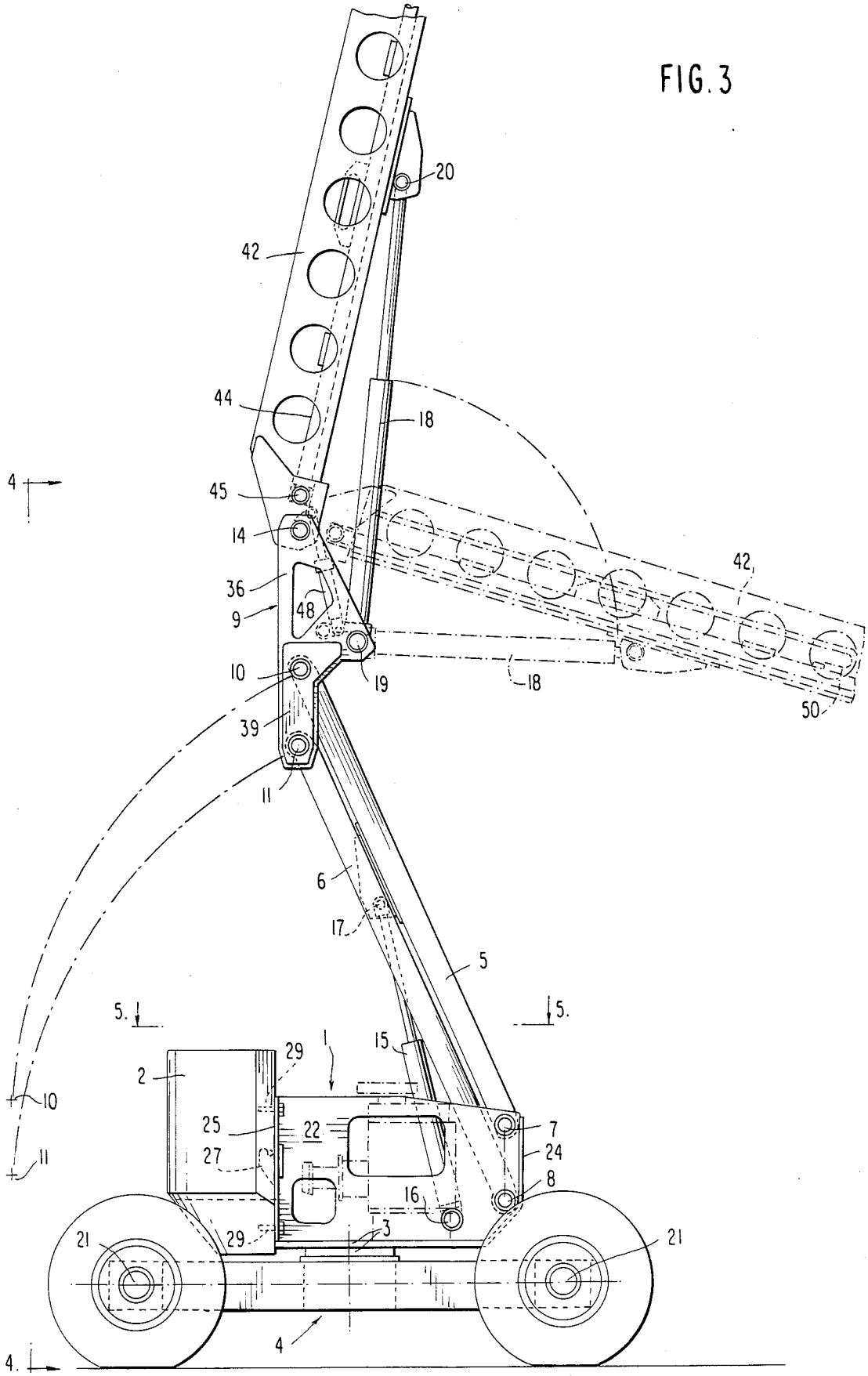
FIG. 3 is a fragmentary side elevational view showing the telescopic boom assembly moved to a raised position relative to the vehicle.

The details of the construction of the machine of the present invention are illustrated in FIGS. 3, 4 and 5 wherein it will be seen that, to obtain the low profile feature, the turntable 3 is positioned in a horizontal plane in close proximity to the plane of the vehicle axles 21. The superstructure support frame 1 comprises a pair of closely spaced side walls 22, 23 secured to the turntable 3 and having a front end wall 24 and a pair of outwardly extending transverse rear walls 25 and 26. The detachable counterweight 2 is hooked as at 27 and 28 to the rear walls 25 and 26 and bolted in place as at 29 and 30. The counterweight 2 is also provided with lift pins 31 whereby a crane can lift the weight for connecting it to the superstructure support frame.

As will be seen in FIG. 5, the parallel arms 5 and 6 are of tubular or box construction in cross section and are positioned in the space between the superstructure side walls 22 and 23, the pivotal connections 7 and 8 being vertically aligned as shown in FIG. 3. The space between the side walls 22 and 23 provides a trough 32 aligned with the centerline of the vehicle chassis 4 and aligned with a similar trough 33 provided in the counterweight 2. By this construction and arrangement the parallel arms 5 and 6 are aligned with the centerline of the vehicle chassis and are received within the troughs when the machine is lowered, as shown in FIG. 2. This arrangement also contributes to the low profile feature of the machine, which has a height of approximately eight and a half feet when positioned as shown in FIG. 2. Machines with lower maximum work platform heights will have a lower overall height. While in the lowered position, as shown in FIG. 2, the parallel arms 5 and 6 are slightly inclined in a direction toward the rear of the vehicle, although they are in substantially horizontal planes, and thus are initially oriented or positioned to move in a lifting mode as soon as the lift cylinder 15 is actuated as shown in FIG. 3.

Since the arms 5 and 6 are of tubular construction, as will be seen in FIG. 4, a portion of the top and bottom walls of lower arm 6 are cut-away to form openings 34 and 35, respectively, to accommodate the lift cylinder 15 and associated piston rod during the raising and lowering of the arms.

Referring to FIG. 4, the riser frame assembly 9 is configured as a channel member having a pair of spaced, parallel side walls 36 and 37 interconnected by a web member 38. Reinforcing plates 39 and 40 are provided on the side walls 36 and 37 at the pivotal connections 10 and 11 of the arms 5 and 6. As will be shown in FIG. 1, by the construction and arrangement of the lift arms 5 and 6 and riser frame assembly 9, the telescopic boom assembly 12 is provided with an elevated pivot connection 14, on the order of fifteen feet above the ground, so that the boom 12 can extend over an obstruction 41 when the boom is horizontally oriented. This type of machine is sometimes referred to as an up and over machine. The riser frame assembly 9 always remains vertically oriented in all positions of orientation of the machine. The elevated pivot connection 14 also allows for the telescopic boom assembly 12 and associated work platform 13 to be luffed and extended to a position shown in phantom in FIG. 1, wherein the work platform 13 extends approximately sixty feet above the ground.

To complete the description of the vehicular, low profile, self propelled aerial work platform of the present invention, the telescopic boom assembly comprises a base section 42 and a telescopic boom section 43, the base section containing a fluid cylinder 44 fixed to the inner end of the base section as at 45 and having a piston rod 46 extending into the telescopic section 43 and fixed thereto as at 47. A master cylinder 48 is connected between the riser frame assembly 9 and the inner end of the base section 12, the master cylinder 48 being in fluid communication with a slave cylinder 49 mounted on the outer end of the telescopic boom section 43 and connected to the work platform 13 whereby the work platform 13 is maintained in a horizontal position during the luffing of the telescopic boom assembly 12, as well known in the art. The base boom section 42 also contains a carrier track assembly 50 for supporting various power cables and hoses extending through the telescopic boom assembly to the conventional controls mounted on the work platform 13, whereby the worker on the platform can control the maneuvering of the vehicle as well as the sluing and luffing of the telescopic boom assembly.

The structure is completely symmetrical since the telescopic boom assembly 12, boom lift cylinder 18, the pair of parallel arms 5 and 6 and the lower lift cylinder 15 are all positioned in the same vertical plane aligned with the centerline of rotation of turntable 3, and aligned with the centerline of the vehicle chassis in the lowered position of the machine, so that a load on the work platform 13 and the weight of machine components do not transmit any torque to the turntable, as is the case in most prior art machines of this same general type. The geometry of the positioning of the various structural elements in closely adjacent substantially horizontal planes relative to each other, and the vertical alignment of the pivot connections of the parallel arms 5 and 6 to the support frame, and the vertical alignment of the pivot connections of the parallel arms to the riser frame assembly 9, and vertical alignment with the pivot connection of the telescopic boom to the riser frame assembly are important aspects of the invention which provide the low profile capabilities of the machine in its retracted travel position.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A vehicular low profile self propelled aerial work platform comprising a vehicle chassis, a turntable mounted on said vehicle chassis and positioned in a horizontal plane in close proximity to the axles of the vehicle, a superstructure support frame mounted on said turntable, said superstructure support frame including a pair of closely spaced side walls, a pair of substantially parallel arms extending into the space between said side walls, each arm having one end pivotally connected to said side walls, a riser frame assembly, the opposite end of each arm being pivotally connected to said riser assembly, a first lift cylinder positioned in the space between the side walls and having one end pivotally connected thereto, the opposite end of said first lift cylinder being operably connected to one of said arms, a telescopic boom assembly and associated work platform pivotally connected to said riser assembly, a second lift cylinder operatively connected between said riser frame assembly and said telescopic boom assembly for luffing said boom assembly, the superstructure side walls, parallel arms and riser frame assembly providing a parallelogram linkage assembly, whereby upon actuation of said first lift cylinder the parallel arms and riser frame assembly are moved in a vertical plane, a counterweight connected to one end of the superstructure support frame and extending transversely to said side walls, a trough formed in said counterweight, said trough being aligned with the space between said side walls, whereby the parallel arms extend between the superstructure side walls and through the counterweight trough when the first and second lift cylinders are retracted to move the riser frame assembly and telescopic boom assembly to the lowermost position wherein the boom assembly is lowered to a negative angle, whereby the vehicle and associate boom assembly can be easily maneuvered through low and narrow doorways and aisles in warehouses and manufacturing plants.

2. A vehicular low profile self propelled aerial work platform according to claim 1, wherein the superstructure support frame, parallel arms, riser frame assembly and telescopic boom assembly are constructed and arranged symmetrical with respect to the centerline of the machine, whereby load stresses are equally distributed from the telescopic boom to the riser assembly through the arms and superstructure side walls.

3. A vehicular low profile self propelled aerial work platform according to claim 1, wherein, when the machine is in the elevated position, the riser frame assembly, parallel arms, superstructure support frame and counterweight are all positioned within the wheel base of the vehicle, to thereby provide a zero tailswing.

4. A vehicular low profile self propelled aerial work platform according to claim 1, wherein the arms are of tubular construction and are disposed substantially in a vertical plane with respect to each other.

5. A vehicular low profile self propelled aerial work platform according to claim 4, wherein the first lift is operatively connected to the upper arm.

6. A vehicular low profile self propelled aerial work platform according to claim 5, wherein portions of the top and bottom walls of the lower arm are cut-away to provide openings to accommodate the first lift cylinder during the raising and lowering of the arms.

7. A vehicular low profile self propelled aerial work platform according to claim 4, wherein the pivotal connection of the arms to the side walls of the superstructure support frame are vertically aligned and positioned beneath said telescopic boom assembly when in the negative angle position.

8. A vehicular low profile self propelled aerial work platform according to claim 7, wherein the parallel arms are slightly inclined when in the lowered position to thereby be positioned in a lifting mode as soon as the first lift cylinder is actuated.

9. A vehicular low profile self propelled aerial work platform according to claim 1 wherein the arms and riser frame assembly are constructed and arranged to provide an elevated pivot connection for the telescopic boom assembly, whereby the boom pivot connection extends approximately eight feet above the ground when the riser frame assembly is lowered to move the boom assembly to the negative angle position, and extends approximately fifteen feet above the ground when the riser frame assembly is moved to the elevated position.

10. A vehicular low profile self propelled aerial work platform according to claim 8, in which the parallel arms and telescopic boom assembly are inclined in the same direction toward the front of the vehicle when said telescopic boom assembly is in the negative angle position.

11. A vehicular low profile self propelled aerial work platform according to claim 1, wherein said pair of parallel arms, first lift cylinder, riser frame assembly, second lift cylinder, and telescopic boom assembly are symmetrically positioned in a common vertical plane.

12. A vehicular low profile self propelled aerial work platform according to claim 11, in which said telescopic boom assembly, said second lift cylinder and said pair of parallel arms are respectively positioned one above the other when in the lowered position.

13. A vehicular low profile self propelled aerial work platform according to claim 7, in which said turntable having a centerline of rotation on said vehicle chassis, and the pivotal connections of the arms to the side walls of the superstructure support frame being on the same side of the turntable centerline of rotation as the work platform on the end of the telescopic boom assembly.

14. A vehicular low profile self propelled aerial work platform according to claim 7, in which the pivotal connection of the arms to said riser frame assembly are vertically aligned, and the pivot connection of said telescopic boom assembly to said riser assembly being positioned above and vertically aligned with the pivotal connections of the arms to said riser frame assembly.

15. A vehicular low profile self propelled aerial work platform according to claim 14, and said second lift cylinder pivotally connected to said riser frame assembly at a position between the pivotal connections of the arms and the pivot connection of said telescopic boom assembly to said riser assembly.

16. A vehicular low profile self propelled aerial work platform according to claim 1, wherein the pair of substantially parallel arms are positioned in substantially horizontal planes above and in close proximity to the plane of said turntable, and said second lift cylinder positioned in a substantially horizontal plane above and in close proximity to the horizontal planes of said arms in the retracted position of the machine with the telescopic boom assembly in a negative angle position.

17. A vehicular low profile self propelled aerial work platform according to claim 16, and the pivotal connection of the telescopic boom assembly to said riser frame assembly positioned above the pivotal connection of said second lift cylinder to said riser frame assembly, and in vertical alignment with the pivotal connections of the arms to said riser frame assembly.

* * * * *